US007530482B1

(12) United States Patent
Ho

(10) Patent No.: US 7,530,482 B1
(45) Date of Patent: May 12, 2009

(54) PROTECTION DEVICE OF NAIL DRIVER FOR PREVENTING FROM TRIGGERING IN INEFFECTIVE ACTUATION

(75) Inventor: Yu-Chuan Ho, Taichung County (TW)

(73) Assignee: Apach Industrial Co., Ltd, Taichung County (TW)

( * ) Notice: Subject to any disclaimer, the term of this patent is extended or adjusted under 35 U.S.C. 154(b) by 34 days.

(21) Appl. No.: 11/874,216

(22) Filed: Oct. 18, 2007

(51) Int. Cl.
*B25C 1/04* (2006.01)

(52) U.S. Cl. ..... 227/8; 227/130

(58) Field of Classification Search ..... 227/120, 227/130, 8; 123/46 SC
See application file for complete search history.

(56) References Cited

U.S. PATENT DOCUMENTS 5,219,110 A * 6/1993 Mukoyama ..... 227/8
5,593,079 A * 1/1997 Mukoyama et al. ..... 227/8
5,715,982 A * 2/1998 Adachi ..... 227/8
6,024,267 A * 2/2000 Chen ..... 227/8
6,170,729 B1 * 1/2001 Lin ..... 227/8
6,186,386 B1 * 2/2001 Canlas et al. ..... 227/142
6,929,165 B1 * 8/2005 Chen et al. ..... 227/8
7,004,367 B1 * 2/2006 Shen et al. ..... 227/8
7,143,918 B2 * 12/2006 Aguirre et al. ..... 227/8
7,152,773 B2 * 12/2006 Ke ..... 227/8
7,213,732 B2 * 5/2007 Schell et al. ..... 227/8
7,314,154 B2 * 1/2008 Huang et al. ..... 227/8
7,458,492 B2 * 12/2008 Terrell et al. ..... 227/8

* cited by examiner

*Primary Examiner*—Scott A. Smith

(57) ABSTRACT

A protection device of a nail driver for preventing from triggering in a state of ineffective actuation comprises a trigger device including a trigger, a trigger sheet, and an ejecting rod; the trigger being installed at an inner side of the body of the nail driver; a lower end of the trigger sheet being elastically pivoted to an inner side of the trigger; thus, the trigger sheet elastically resisting against the ejecting rod; therefore, when the trigger is pressed, the trigger sheet will drive the ejecting rod to pivotally rotate; a safety device including a sliding unit, and a driving rod; the sliding unit being slideably installed at a lower side of the body; one end of the sliding unit extending to a shooting head of the nail driver; the driving rod being elastically pivoted at another end of the sliding unit; the driving rod is a unidirectional confinement structure.

7 Claims, 6 Drawing Sheets

PROTECTION DEVICE OF NAIL DRIVER FOR PREVENTING FROM TRIGGERING IN INEFFECTIVE ACTUATION

FIELD OF THE INVENTION

The present invention relates to a protection device of a nail driver for preventing from triggering in a state of ineffective actuation, which has a trip and restoration devices. Thus, when the trigger is actuated ineffectively, no nail is shot.

BACKGROUND OF THE INVENTION

In the prior art switching of the nail driver, the nail driver has a supporting seat, a stop, and a spring. The supporting seat has a supporting rod and a positioning rod so that the stop can pivot to the supporting seat by using the positioning rod. The supporting seat is combined with the trigger by the supporting rod. The spring is hooked between the supporting seat and the trigger so that the supporting seat can be driven elastically. The contact position between the stop and a safety sliding rod of the nail drive can be switched easily so as to select a single shooting function or continuous shooting function. Above switching structure is hidden in the body of the trigger so as to save the space required and prevent a fault operation.

However in above prior art structure, when the trigger is pressed idly (ineffectively), the stop will separate from the sliding rod, while the sliding rod has no driving rod when the user releases the trigger to restore the stop to be in contact with the sliding rod, the sliding rod will resist against the stop at a reverse direction so that the stop can not restore successfully. Thus it can not be trigger again.

SUMMARY OF THE INVENTION

Accordingly, the primary object of the present invention is to provide a protection device of a nail driver for preventing from triggering in a state of ineffective actuation, which has a trip and restoration devices. Thus, when the trigger is actuated ineffectively, no nail is shot.

To achieve above objects, the present invention provides a protection device of a nail driver for preventing from triggering in a state of ineffective actuation comprising: a trigger device including a trigger, a trigger sheet, and an ejecting rod; the trigger being installed at an inner side of the body of the nail driver; the trigger sheet being a sheet like body; a center of the trigger sheet resting upon the ejecting rod; a lower end of the trigger sheet being elastically pivoted to an inner side of the trigger; thus, the trigger sheet elastically resisting against the ejecting rod; therefore, when the trigger is pressed, the trigger sheet will drive the ejecting rod to pivotally rotate; a safety device including a sliding unit, and a driving rod; the sliding unit being slideably installed at a lower side of the nail driver body; one end of the sliding unit extending to a shooting head of the nail driver; the driving rod being elastically pivoted at another end of the sliding unit; the driving rod is a unidirectional confinement structure, wherein when no external force is applied to the safety device, and the trigger is actuated, the trigger sheet will eject the ejecting rod to push the driving rod, and drive the sliding unit to move forwards, when it move through a predetermined distance, the trigger sheet 22 will separate from the driving rod; thus the trigger is not actuated; by the unidirectional confinement function of the driving rod, the restoration of the trigger sheet will not be hindered by the driving rod.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
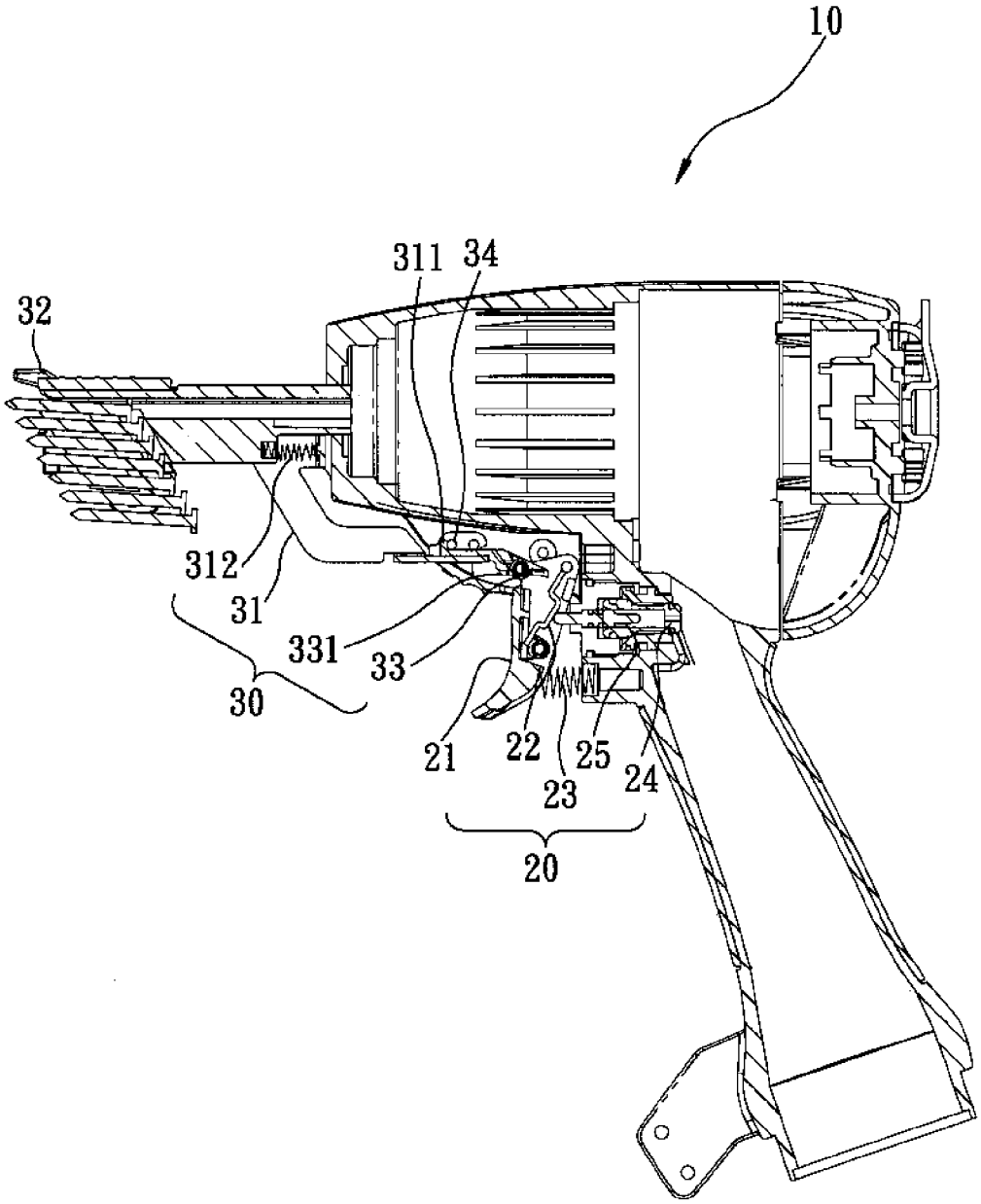
FIG. 1 is a schematic cross sectional view of the protection device of a nail driver of the present invention.
Figure 2:
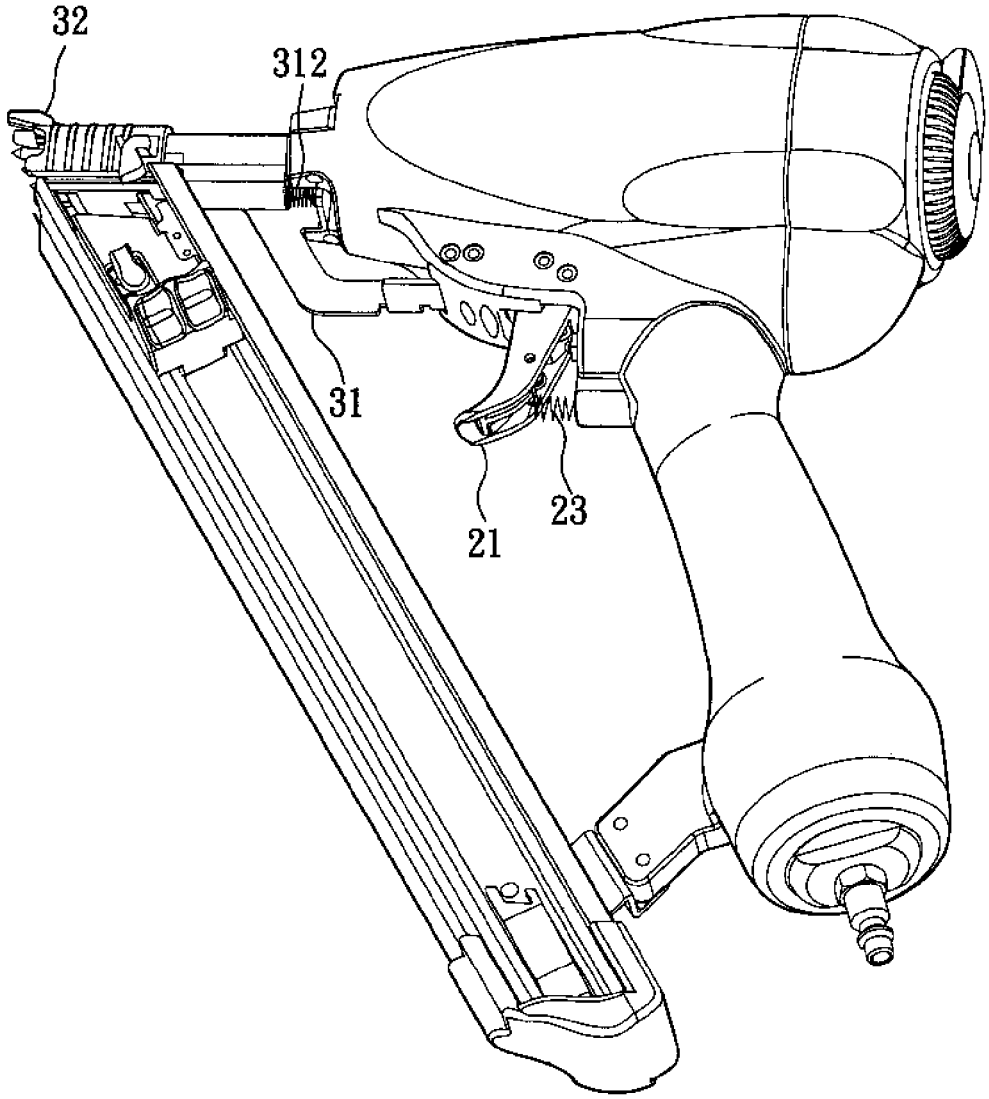
FIG. 2 is a schematic perspective view of the protection device of a nail driver of the present invention.
Figure 3:
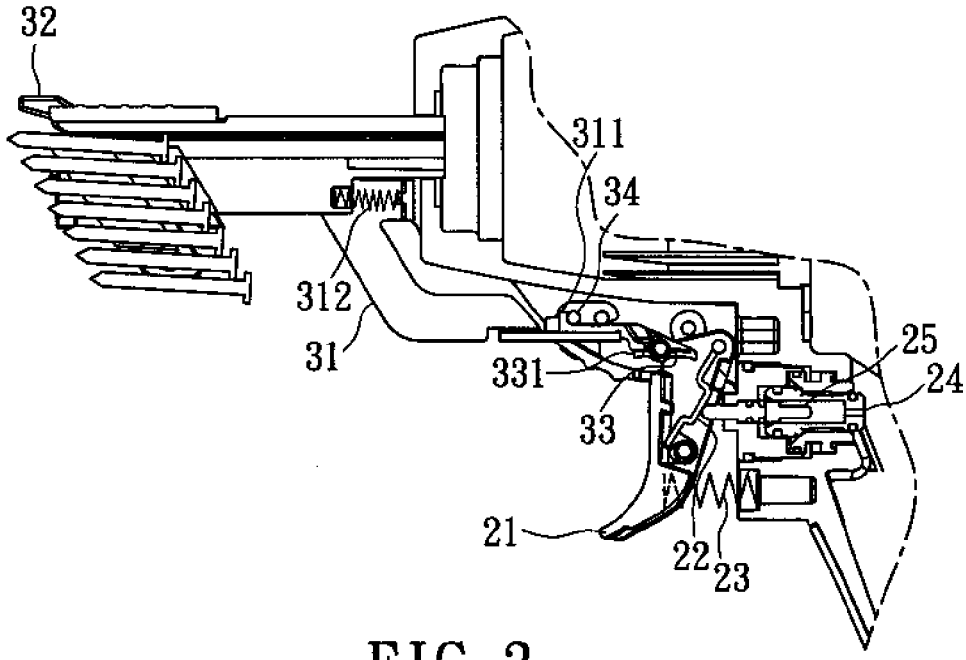
FIGS. 3 to 7 show the operation flow of the protection device of a nail driver of the present invention.
Figure 4:
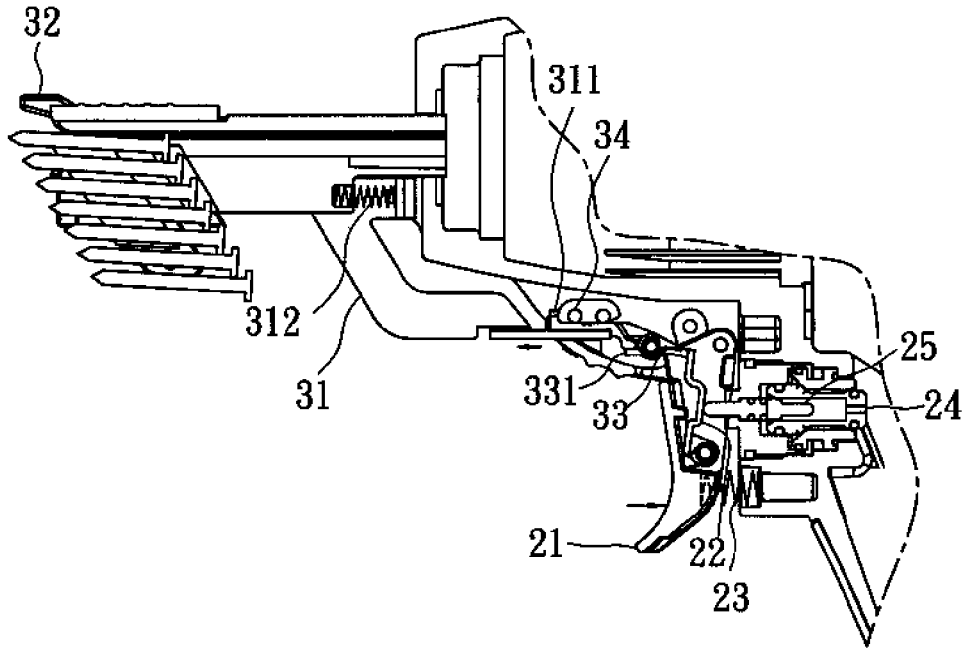
Figure 5:
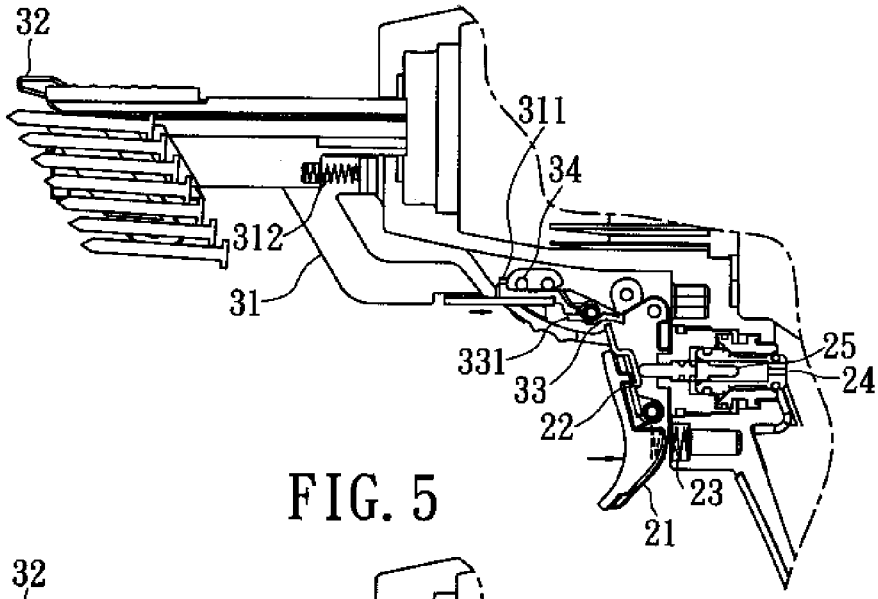
Figure 6:
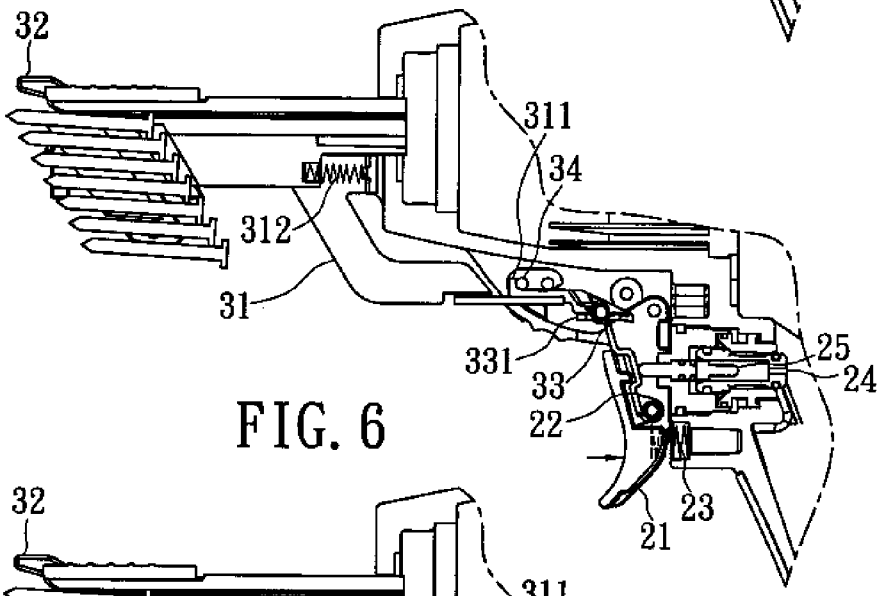
Figure 7:
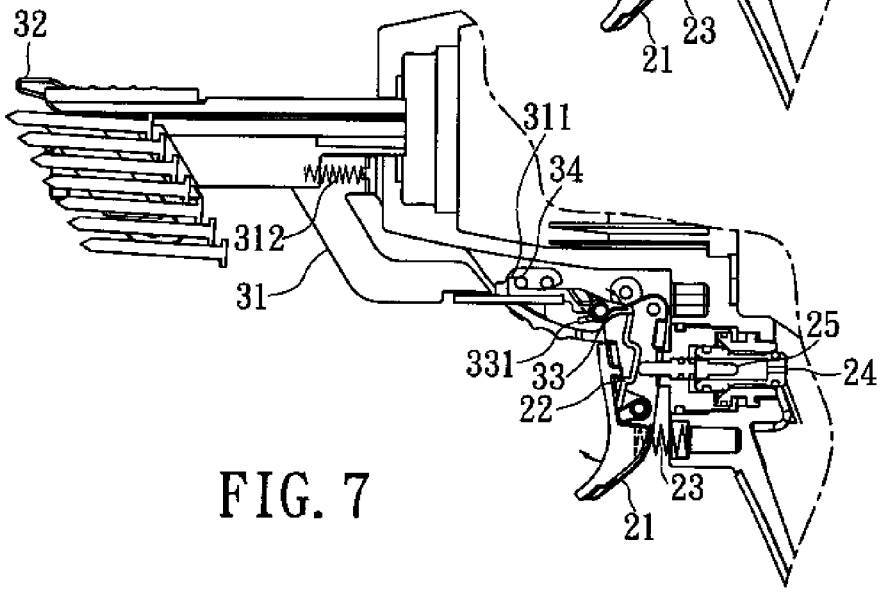
Figure 8:
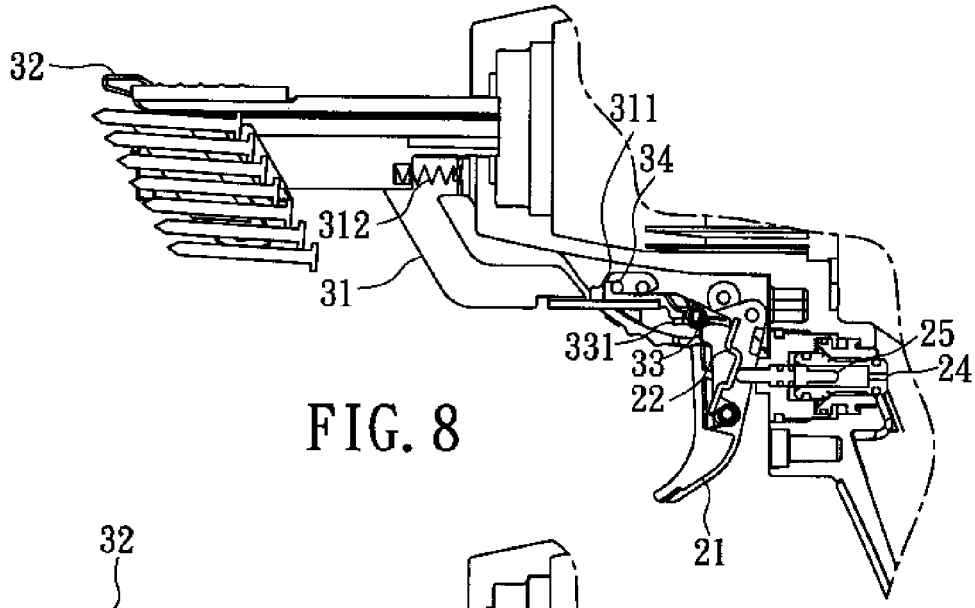
FIGS. 8 to 13 are schematic view showing the flow of the triggering operation of the present invention.
Figure 9:
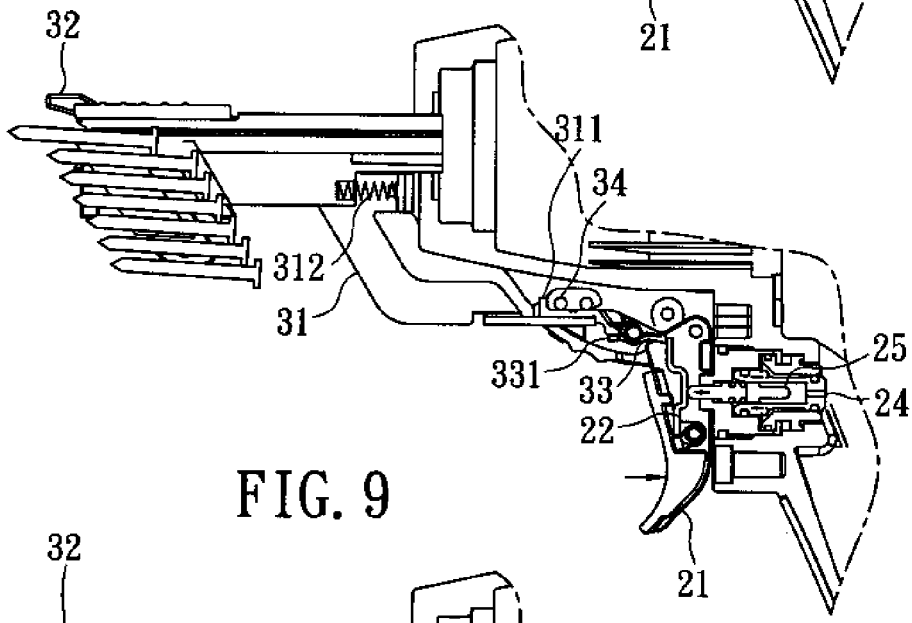
Figure 10:
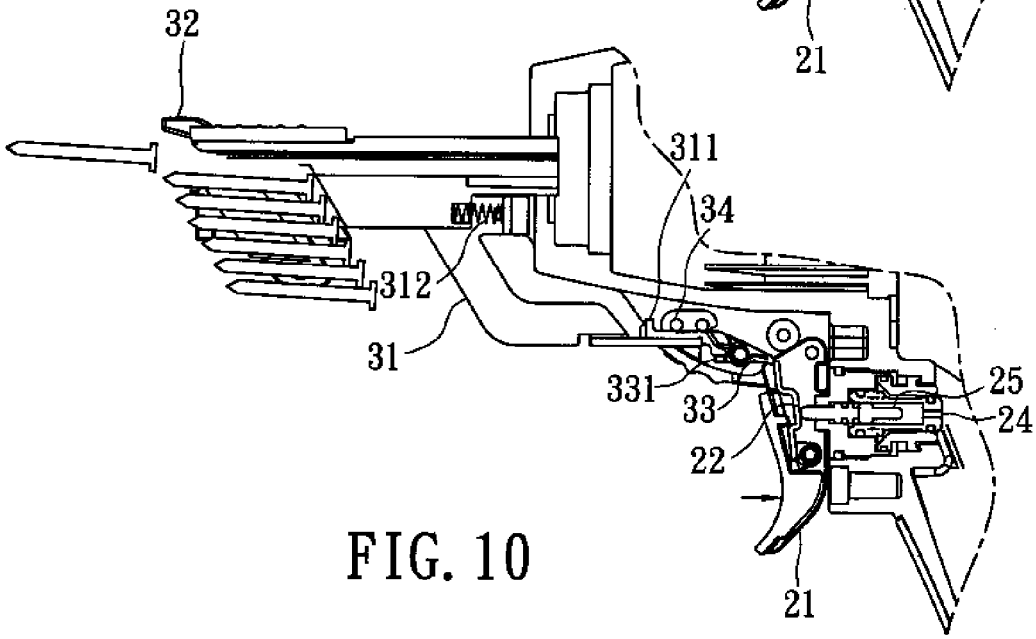
Figure 11:
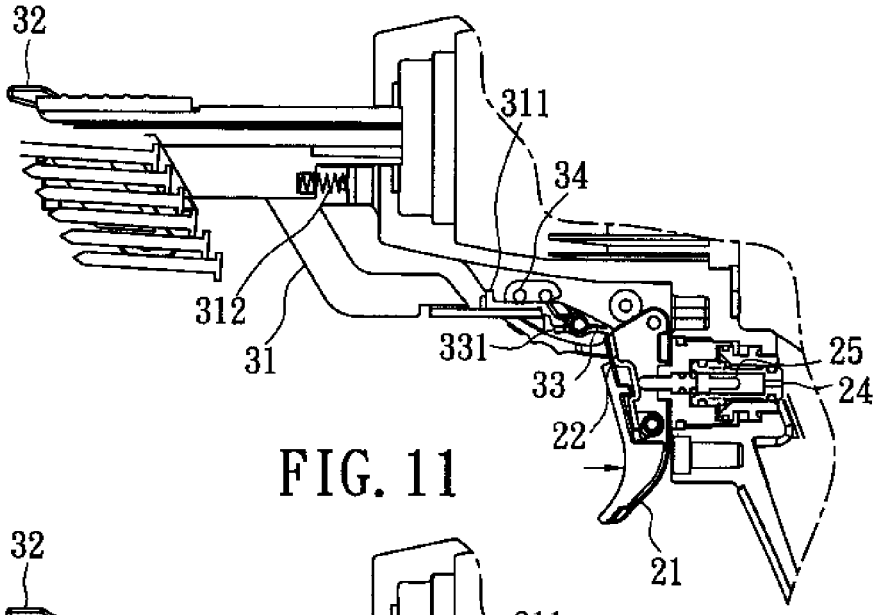
Figure 12:
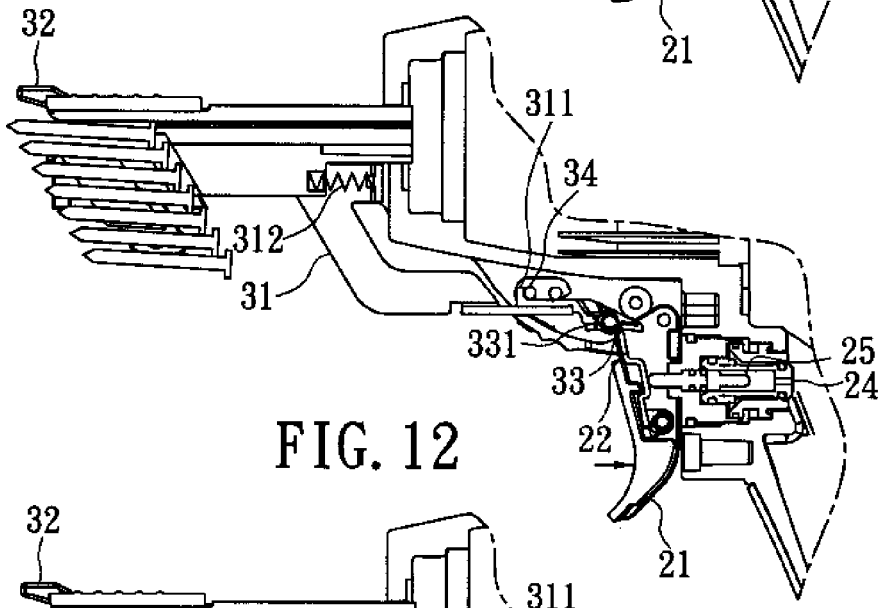
Figure 13:
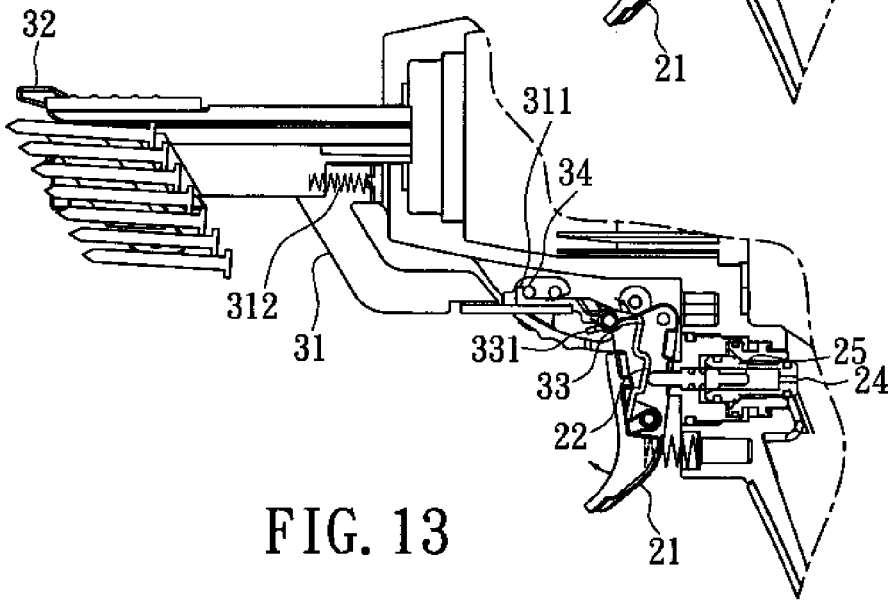

Referring to FIGS. 1 and 2, the idle protection device of a nail driver body 10 comprises the following elements.

A trigger device 20 includes a trigger 21, a trigger sheet 22, an elastic unit 23, an ejecting rod 24 and a switch valve 25. The trigger 21 is installed at an inner side of the body 1 of the nail driver. The trigger sheet 22 is a sheet like body. A center of the trigger sheet 22 rests upon the ejecting rod 24. A lower end of the trigger sheet 22 is elastically pivoted to an inner side of the trigger 21. Thus, the trigger sheet 22 elastically resists against the ejecting rod 24. Therefore, when the trigger 21 is pressed, the trigger sheet 22 will drive the ejecting rod 24 to pivotally rotate. The elastic unit 23 is connected the body 10 and a lower inner end of the trigger 21 for returning the trigger 21. The switch valve 25 serves to install the ejecting rod 24.

The safety device 30 includes a sliding unit 31, an ejecting end 32, a driving rod 33 and a brake unit 34. The sliding unit 31 is slideably installed at a lower side of the nail driver body 10. One end of the sliding unit 31 extends to a shooting head of the nail driver. The sliding unit 31 has an elastic unit 312 which is connected to the head of the nail driver body 10 for returning the sliding unit 31. The ejecting end 32 is installed at the head of the nail driver body 10. The driving rod 33 is elastically pivoted at another end of the sliding unit 31. Therefore, when the ejecting end 32 is pushed by an external force, the sliding unit 31 will drive the driving rod 33 to eject an upper side of the trigger sheet 22. The driving rod 33 is extended with a positioning end 331. The positioning end 331 is adhered to a bottom of the sliding unit 31 for confining the driving rod 33 to move unidirectionally. The brake unit 34 is installed at a lower side of the nail driver body 10 and above a positioning seat 311 of the sliding unit 31 so as to confine a maximum displacement of the sliding unit 31.

Referring to FIGS. 3 to 7, the operation of the present invention will be described herein. When the ejecting end 32 is not ejected so that that no external force is applied to the safety device 30 (referring to FIG. 3), as the trigger 21 is actuated, the trigger sheet 22 will axially eject the ejecting rod 24 to pivotally rotate to push the driving rod 33 and then drive the sliding unit 31 to move forwards (referring to FIG. 4). When it move through a distance, the trigger sheet 22 will separate from the driving rod 33 (referring to FIGS. 5 and 6) so that no nail is triggered and the driving rod 33 has the effect of unidirectional confinement. The restoring of the trigger sheet 22 will not be hindered by the driving rod 33.

Referring to FIGS. 8 to 13, the trigger process of the present invention is illustrated. When the ejecting end 32 is ejected so that the sliding unit 31 is ejected by an external force (referring to FIG. 8) and the trigger 21 is actuated, an upper side of the trigger sheet 22 is ejected by the driving rod 33, so that the trigger sheet 22 pushes the ejecting rod 24 to compress the switch valve 25 (referring to FIG. 9). When switch valve 25 is pushed by a predetermined pressure, it will push the ejecting rod 24 along a reverse direction (referring to FIG. 10) so that the ejecting rod 24 pushes the trigger 21 to drive the sliding unit 31 to displace (referring to FIG. 11). When it moves through a predetermined distance, the trigger sheet 22 will separate from the driving rod 33 (referring to FIG. 12). Therefore, the trigger operation is complete and by the unidirectional confinement of the driving rod 33, when the trigger sheet 22 returns, it will not be hindered by the driving rod 33 (referring to FIG. 13).

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A protection device of a nail driver for preventing from triggering in a state of ineffective actuation, comprising:

a trigger device including a trigger, a trigger sheet, and an ejecting rod; the trigger being installed at an inner side of the body of the nail driver; the trigger sheet being a sheet like body; a center of the trigger sheet resting upon the ejecting rod; a lower end of the trigger sheet being elastically pivoted to an inner side of the trigger; thus, the trigger sheet elastically resisting against the ejecting rod; therefore, when the trigger is pressed, the trigger sheet will drive the ejecting rod to pivotally rotate;

a safety device including a sliding unit, and a driving rod; the sliding unit being slideably installed at a lower side of the nail driver body; one end of the sliding unit extending to a shooting head of the nail driver; the driving rod being elastically pivoted at another end of the sliding unit; the driving rod is a unidirectional confinement structure, wherein when no external force is applied to the safety device, and the trigger is actuated, the trigger sheet will eject the ejecting rod to push the driving rod, and drive the sliding unit to move forwards, when it move through a predetermined distance, the trigger sheet will separate from the driving rod; thus the trigger is not actuated; by the unidirectional confinement function of the driving rod, the restoration of the trigger sheet will not be hindered by the driving rod.

2. The protection device of a nail driver for preventing from triggering in a state of ineffective actuation as claimed in claim 1, wherein the driving rod is extended with a positioning end; and the positioning end is adhered to a bottom of the sliding unit for confining the driving rod to move unidirectionally.

3. The protection device of a nail driver for preventing from triggering in a state of ineffective actuation as claimed in claim 1, wherein a brake unit is installed at a lower side of the nail driver body and above a positioning seat of the sliding unit so as to confine a maximum displacement of the sliding unit.

4. The protection device of a nail driver for preventing from triggering in a state of ineffective actuation as claimed in claim 1, wherein an ejecting end is installed at the head of the nail driver body; when the ejecting end is pushed by an external force, the sliding unit will drive the driving rod to eject an upper side of the trigger sheet.

5. The protection device of a nail driver for preventing from triggering in a state of ineffective actuation as claimed in claim 1, wherein a switch valve is used to install the ejecting rod.

6. The protection device of a nail driver for preventing from triggering in a state of ineffective actuation as claimed in claim 1, wherein an elastic unit is connected between the body and a lower inner end of the trigger for returning the trigger.

7. The protection device of a nail driver for preventing from triggering in a state of ineffective actuation as claimed in claim 1, wherein the sliding unit has an elastic unit which is connected to the head of the nail driver body for returning the sliding unit.

* * * * *